US009791165B2

(12) United States Patent
McKay et al.

(10) Patent No.: US 9,791,165 B2
(45) Date of Patent: Oct. 17, 2017

(54) AIR CONDITIONER UNITS HAVING IMPROVED CONDENSATE REMOVAL ASSEMBLIES

(71) Applicant: General Electric Company, Schenectady, NY (US)

(72) Inventors: Brian Bernard McKay, Louisville, KY (US); Robert William Jewell, Louisville, KY (US); Sugumar Vedachalam, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 199 days.

(21) Appl. No.: 14/860,789

(22) Filed: Sep. 22, 2015

(65) Prior Publication Data

US 2017/0082317 A1 Mar. 23, 2017

(51) Int. Cl.

| | |
|---|---|
| ***F24F 13/22*** | (2006.01) |
| ***F24F 1/02*** | (2011.01) |
| ***F25D 21/14*** | (2006.01) |
| ***F24F 6/02*** | (2006.01) |
| ***F28F 17/00*** | (2006.01) |

(52) U.S. Cl.

CPC ..... *F24F 13/224* (2013.01); *F24F 1/027* (2013.01); *F24F 6/02* (2013.01); *F28F 17/005* (2013.01)

(58) Field of Classification Search

CPC ..... F24F 1/42; F24F 6/00; F24F 6/02; F24F 6/08; F24F 13/224; F24F 2013/225; F24F 2006/001; F24F 2006/046; F25D 2321/1412; F25D 2321/142

See application file for complete search history.

(56) References Cited

U.S. PATENT DOCUMENTS

| | | | | |
|---|---|---|---|---|
| 2,696,716 A * | 12/1954 | Marks | F25D 21/14 62/286 |
| 3,193,259 A * | 7/1965 | Liebmann | F24F 6/04 126/113 |
| 3,570,822 A * | 3/1971 | Peterson | F24F 6/04 126/113 |
| 4,158,679 A * | 6/1979 | Yeagle | F24F 6/04 126/113 |

(Continued)

FOREIGN PATENT DOCUMENTS

| | | |
|---|---|---|
| KR | 20020009723 A | 2/2002 |
| KR | 100509051 B1 | 8/2005 |

*Primary Examiner* — Christopher R Zerphey

(74) *Attorney, Agent, or Firm* — Dority & Manning, P.A.

(57) ABSTRACT

Air conditioner units are provided. An air conditioner unit includes an outdoor heat exchanger disposed in an outdoor portion, an indoor heat exchanger disposed in an indoor portion, and a bulkhead disposed between the outdoor heat exchanger and the indoor heat exchanger. The air conditioner unit further includes a pump disposed in the outdoor portion, and a conduit in fluid communication with the pump. The air conditioner unit further includes a receptacle disposed in the indoor portion, the receptacle in fluid communication with the conduit for receiving fluid from the conduit. The receptacle includes a tray defining a channel, and a riser extending from a bottom wall of the tray. The riser includes a raised surface disposed above the bottom wall along a vertical direction. A bore extends through and is defined in the raised surface and the bottom wall.

16 Claims, 7 Drawing Sheets

(56) References Cited

U.S. PATENT DOCUMENTS

| | | | | |
|---|---|---|---|---|
| 4,869,075 | A * | 9/1989 | Ikari | F24F 13/224 62/262 |
| 5,851,444 | A * | 12/1998 | Hansell, Jr. | F24F 6/043 239/379 |
| 6,895,770 | B1 | 5/2005 | Kaminski | |
| 8,887,392 | B1 * | 11/2014 | Xu | F24F 13/22 248/205.1 |

* cited by examiner

AIR CONDITIONER UNITS HAVING IMPROVED CONDENSATE REMOVAL ASSEMBLIES

FIELD OF THE INVENTION

The present disclosure relates generally to air conditioner units, and more particularly to air conditioner units which include improved apparatus for removing condensate from the outdoor portions of the air conditioner units.

BACKGROUND OF THE INVENTION

Air conditioner units are conventionally utilized to adjust the temperature within structures such as dwellings and office buildings. In particular, one-unit type room air conditioner units may be utilized to adjust the temperature in, for example, a single room or group of rooms of a structure. A typical such air conditioner unit includes an indoor portion and an outdoor portion. The indoor portion is generally located indoors, and the outdoor portion is generally located outdoors. Accordingly, the air conditioner unit generally extends through a wall, window, etc. of the structure.

In the outdoor portion of a conventional air conditioner unit, a compressor that operates a refrigerating cycle is provided. At the back of the outdoor portion, an outdoor heat exchanger connected to the compressor is disposed, and facing the outdoor heat exchanger, an outdoor fan for cooling the outdoor heat exchanger is provided. At the front of the indoor portion of a conventional air conditioner unit, an air inlet is provided, and above the air inlet, an air outlet is provided. A blower fan and a heating unit are additionally provided in the indoor portion. Between the blower fan and heating unit and the air inlet, an indoor heat exchanger connected to the compressor is provided.

When cooling operation starts, the compressor is driven to operate the refrigerating cycle, with the indoor heat exchanger serving as a cold-side evaporator of the refrigerating cycle, and the outdoor heat exchanger as a hot-side condenser. The outdoor heat exchanger is cooled by the outdoor fan to dissipate heat. As the blower fan is driven, the air inside the room flows through the air inlet into the air passage, and the air has its temperature lowered by heat exchange with the indoor heat exchanger, and is then blown into the room through the air outlet. In this way, the room is cooled.

When heating operation starts, the heating unit is operated to raise the temperature of air in the air passage. The air, having had its temperature raised, is blown out through the air outlet into the room to heat the room.

Further, conventional air conditioner units include a bulkhead which is positioned between the indoor portion and outdoor portion, and thus generally separates the components within the indoor portion from the components in the outdoor portion. Various components may additionally be connected to the bulkhead, such as the blower fan and heating unit.

One issue with known air conditioner units is the generation of condensation in the outdoor portion of the units. This condensation, if allowed to build up in the outdoor portion, can result in overflow issues, part damage and/or mildew issues. One approach to removing such condensation is to flow the condensation to the indoor portion and discard the condensation in the indoor portion. In many cases, the condensation can be utilized in the indoor portion to humidify the associated room by providing the condensation to the indoor heat exchanger. However, issues have arisen with the distribution of condensation on the indoor heat exchanger when presently known approaches are utilized, resulting in sub-par humidification and condensation overflow issues.

Accordingly, improved air conditioner units are desired. In particular, air conditioner units which include improved apparatus for removing condensation from the outdoor portions thereof would be advantageous.

BRIEF DESCRIPTION OF THE INVENTION

Aspects and advantages of the invention will be set forth in part in the following description, or may be obvious from the description, or may be learned through practice of the invention.

In accordance with one embodiment, an air conditioner unit is provided. The air conditioner unit includes an outdoor heat exchanger disposed in an outdoor portion, an indoor heat exchanger disposed in an indoor portion, and a bulkhead disposed between the outdoor heat exchanger and the indoor heat exchanger along a transverse direction. The bulkhead defines the indoor portion and the outdoor portion, and includes a first sidewall, a second sidewall spaced apart from the first sidewall along a lateral direction, and a rear wall extending laterally between the first sidewall and the second sidewall. The rear wall includes an indoor facing surface and an opposing outdoor facing surface. The air conditioner unit further includes a pump disposed in the outdoor portion, and a conduit in fluid communication with the pump and extending between a first end disposed in the outdoor portion and a second end disposed in the indoor portion. The air conditioner unit further includes a receptacle disposed in the indoor portion, the receptacle in fluid communication with the conduit for receiving fluid from the conduit. The receptacle includes a tray defining a channel, and a riser extending from a bottom wall of the tray. The riser includes a raised surface disposed above the bottom wall along a vertical direction. The channel and the riser define a lower fill area and an upper fill area. A bore extends through and is defined in the raised surface and the bottom wall.

In accordance with another embodiment, an air conditioner unit is provided. The air conditioner unit includes a condenser disposed in an outdoor portion, an evaporator disposed in an indoor portion, and a bulkhead disposed between the condenser and the evaporator along a transverse direction. The bulkhead defines the indoor portion and the outdoor portion, and includes a first sidewall, a second sidewall spaced apart from the first sidewall along a lateral direction, and a rear wall extending laterally between the first sidewall and the second sidewall. The rear wall includes an indoor facing surface and an opposing outdoor facing surface. The air conditioner unit further includes a pump disposed in the outdoor portion, and a conduit in fluid communication with the pump and extending between a first end disposed in the outdoor portion and a second end disposed in the indoor portion. The air conditioner unit further includes a receptacle disposed in the indoor portion and coupled to the evaporator, the receptacle in fluid communication with the conduit for receiving fluid from the conduit. The receptacle includes a tray defining a channel, and a riser extending from a bottom wall of the tray. The riser includes a raised surface disposed above the bottom wall along a vertical direction. The channel and the riser define a lower fill area and an upper fill area. A bore extends through and is defined in the raised surface and the bottom wall.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
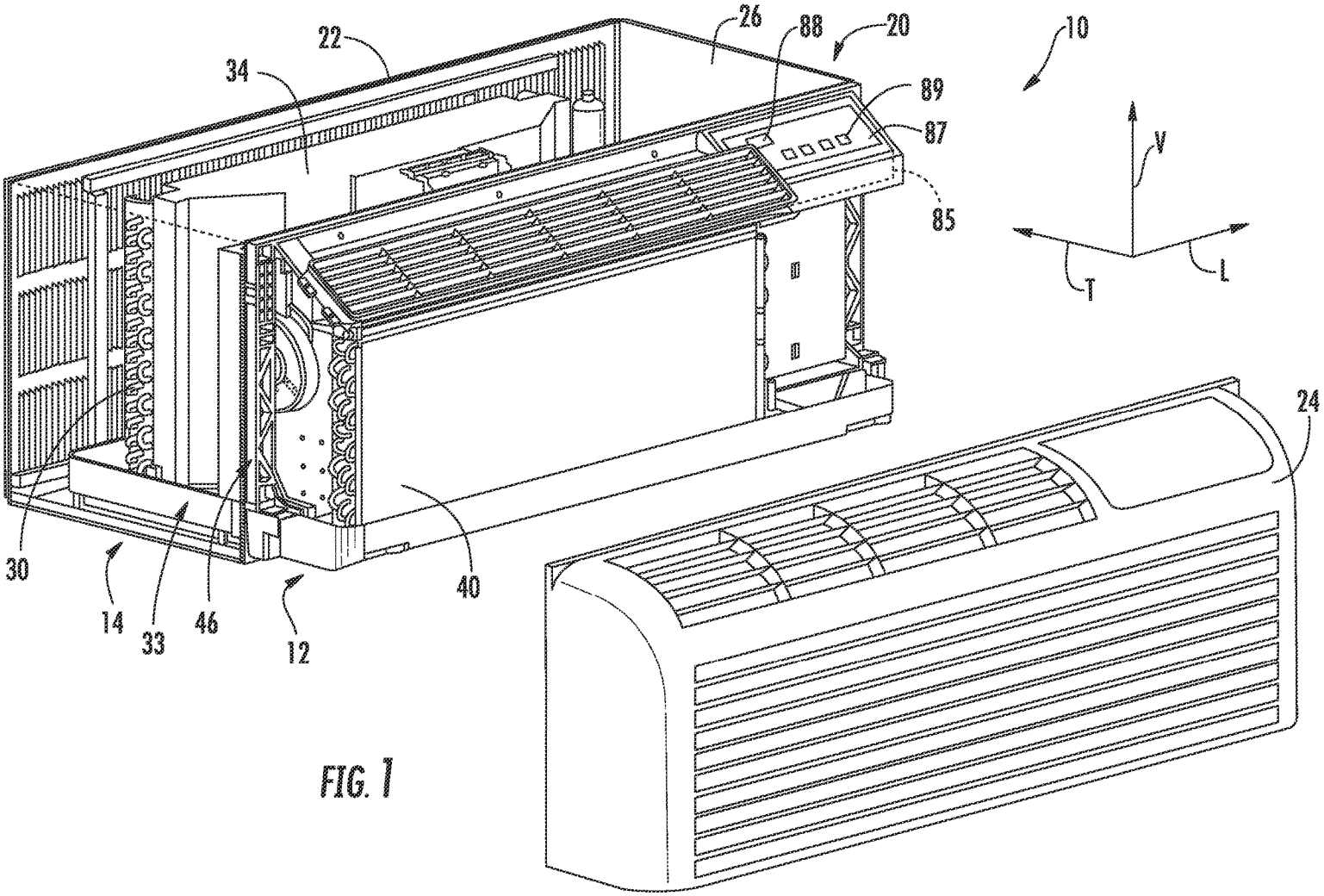
FIG. 1 provides a perspective view of an air conditioner unit, with a room front exploded from a remainder of the air conditioner unit for illustrative purposes, in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to FIG. 1, an air conditioner unit 10 is provided. The air conditioner unit 10 is a one-unit type air conditioner, also conventionally referred to as a room air conditioner. The unit 10 includes an indoor portion 12 and an outdoor portion 14, and generally defines a vertical direction V, a lateral direction L, and a transverse direction T. Each direction V, L, T is perpendicular to each other, such that an orthogonal coordinate system is generally defined.

A housing 20 of the unit 10 may contain various other components of the unit 10. Housing 20 may include, for example, a rear grill 22 and a room front 24 which may be spaced apart along the transverse direction by a wall sleeve 26. The rear grill 22 may be part of the outdoor portion 14, which the room front 24 is part of the indoor portion 12. Components of the outdoor portion 14, such as an outdoor heat exchanger 30 (which may for example be a condenser), outdoor fan (not shown), and compressor (not shown) may be housed within the wall sleeve 26 and disposed on a drip pan 33. A casing 34 may additionally enclose the outdoor fan, as shown.

Figure 2:
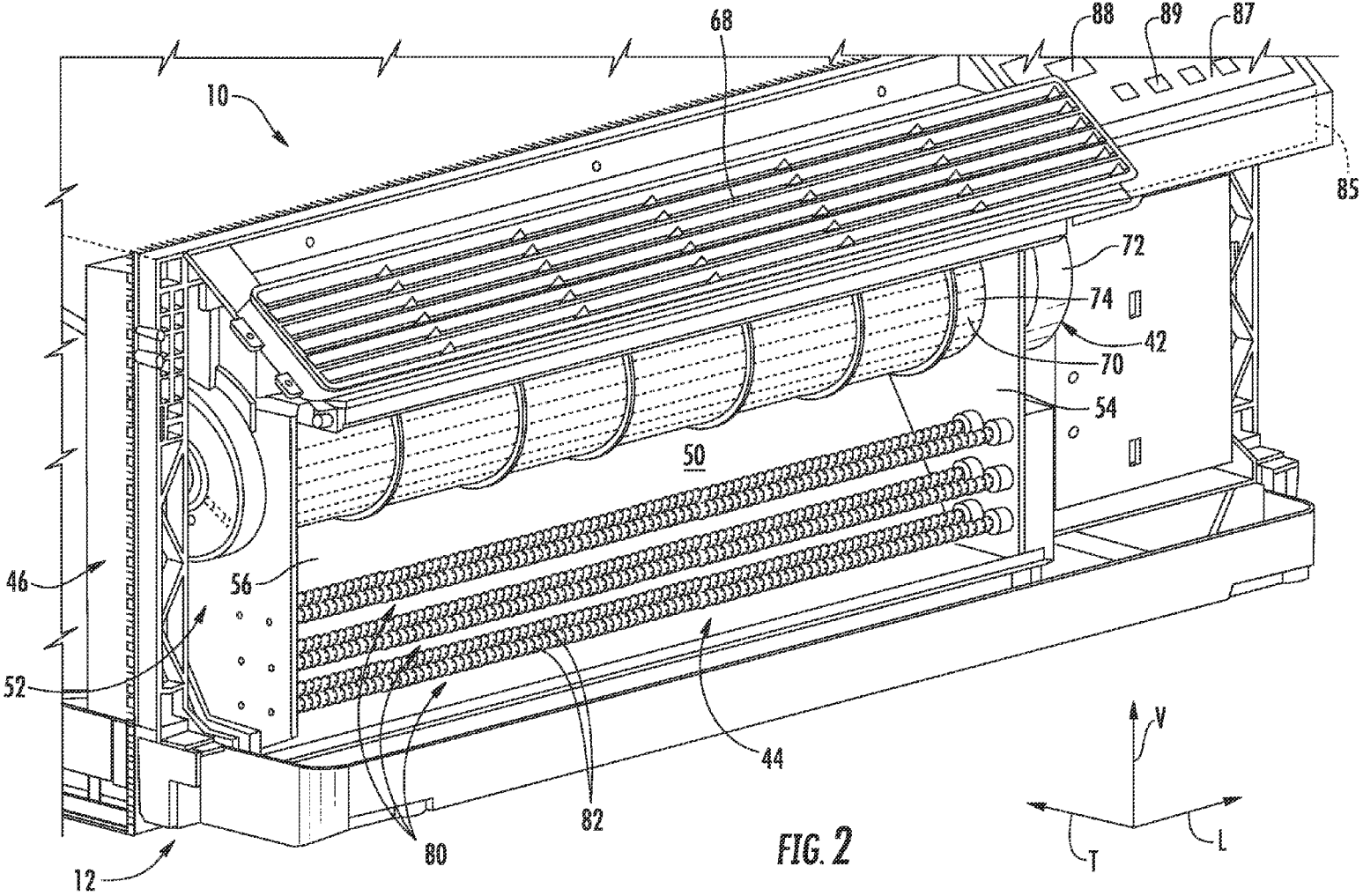
FIG. 2 is a perspective view of components of an indoor portion of an air conditioner unit in accordance with one embodiment of the present disclosure.

Referring now to FIGS. 1 and 2, indoor portion 12 may include, for example, an indoor heat exchanger 40 (which may for example be an evaporator), a blower fan 42, and a heating unit 44. These components may, for example, be housed behind the room front 24. Additionally, a bulkhead 46 may generally support and/or house various other components or portions thereof of the indoor portion 12, such as the blower fan 42 and the heating unit 44. Bulkhead 46 may generally separate and define the indoor portion 12 and outdoor portion 14.

Bulkhead 46 may include various peripheral surfaces that define an interior 50 thereof. For example, and additionally referring to FIG. 3, bulkhead 46 may include a first sidewall 52 and a second sidewall 54 which are spaced apart from each other along the lateral direction L. A rear wall 56 may extend laterally between the first sidewall 52 and second sidewall 54. The rear wall 56 may, for example, include an upper portion 60 and a lower portion 62. Upper portion 60 may for example have a generally curvilinear cross-sectional shape, and may accommodate a portion of the blower fan 42 when blower fan 42 is housed within the interior 50. Lower portion 62 may have a generally linear cross-sectional shape, and may be positioned below upper portion 60 along the vertical direction V. Rear wall 56 may further include an indoor facing surface 64 and an opposing outdoor facing surface. The indoor facing surface 64 may face the interior 50 and indoor portion 12, and the outdoor facing surface 66 may face the outdoor portion 14.

Bulkhead 46 may additionally extend between a top end 61 and a bottom end 63 along vertical axis V. Upper portion 60 may, for example, include top end 61, while lower portion 62 may, for example, include bottom end 63.

Bulkhead 46 may additionally include, for example, an air diverter 68, which may extend between the sidewalls 52, 54 along the lateral direction L and which may flow air therethrough.

In exemplary embodiments, blower fan 42 may be a tangential fan. Alternatively, however, any suitable fan type may be utilized. Blower fan 42 may include a blade assembly 70 and a motor 72. The blade assembly 70, which may include one or more blades disposed within a fan housing 74, may be disposed at least partially within the interior 50 of the bulkhead 46, such as within the upper portion 60. As shown, blade assembly 70 may for example extend along the lateral direction L between the first sidewall 52 and the second sidewall 54. The motor 72 may be connected to the blade assembly 70, such as through the housing 74 to the blades via a shaft. Operation of the motor 72 may rotate the blades, thus generally operating the blower fan 42. Further, in exemplary embodiments, motor 72 may be disposed exterior to the bulkhead 46. Accordingly, the shaft may for example extend through one of the sidewalls 52, 54 to connect the motor 72 and blade assembly 70.

Heating unit 44 in exemplary embodiments includes one or more heater banks 80. Each heater bank 80 may be operated as desired to produce heat. In some embodiments as shown, three heater banks 80 may be utilized. Alternatively, however, any suitable number of heater banks 80 may be utilized. Each heater bank 80 may further include at least one heater coil or coil pass 82, such as in exemplary embodiments two heater coils or coil passes 82. Alternatively, other suitable heating elements may be utilized.

The operation of air conditioner unit 10 including blower fan 42, heating unit 44, and other suitable components may be controlled by a processing device such as a controller 85. Controller 85 may be in communication (via for example a suitable wired or wireless connection) to such components of the air conditioner unit 10. By way of example, the controller 85 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

Unit 10 may additionally include a control panel 87 and one or more user inputs 89, which may be included in control panel 87. The user inputs 89 may be in communication with the controller 85. A user of the unit 10 may interact with the user inputs 89 to operate the unit 10, and user commands may be transmitted between the user inputs 89 and controller 85 to facilitate operation of the unit 10 based on such user commands. A display 88 may additionally be provided in the control panel 87, and may be in communication with the controller 85. Display 88 may, for example be a touchscreen or other text-readable display screen, or alternatively may simply be a light that can be activated and deactivated as required to provide an indication of, for example, an event or setting for the unit.

Figure 3:
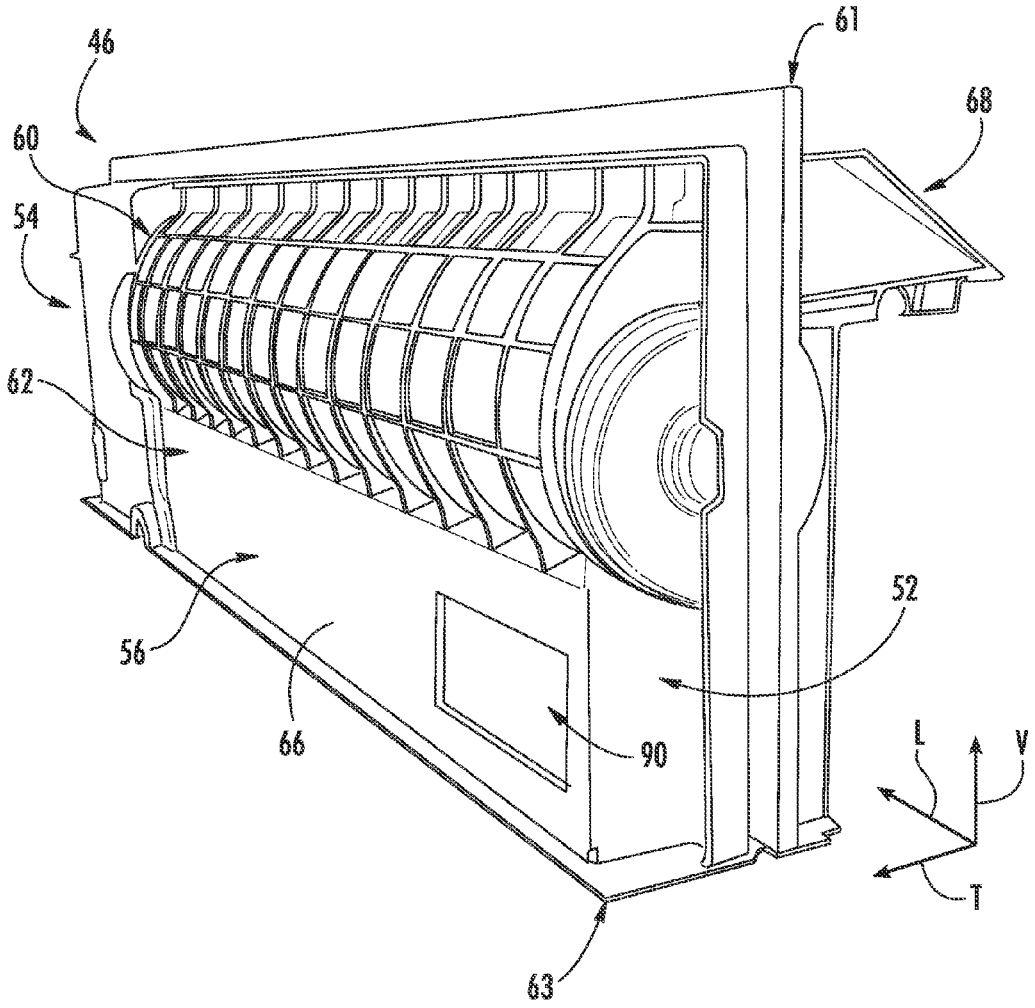
FIG. 3 is a rear perspective view of a bulkhead assembly in accordance with one embodiment of the present disclosure.

Referring briefly to FIG. 3, a vent aperture 90 may be defined in the rear wall 56 of bulkhead 46. Vent aperture 90 may allow air flow therethrough between the indoor portion 12 and outdoor portion 14, and may be utilized in an installed air conditioner unit 10 to allow outdoor air to flow therethrough into the indoor portion 12.

Referring now to FIGS. 4 through 9, air conditioner unit 10 further includes various apparatus for removing condensate from the outdoor portion 14 of the air conditioner unit 10. During operation, condensation may be generated in the outdoor portion 14. This condensation may be allowed to drip and collect into drip pan 33. The apparatus as discussed herein may advantageously remove the fluid (such as the liquid) that collects in the drip pan 33 and flow this fluid to the indoor portion 12. Further, the fluid may advantageously be generally evenly distributed to the indoor heat exchanger 40 for use during heat exchange, which may cause evaporation of the fluid and resulting humidification of a room associated with the indoor portion 12.

Figure 4:
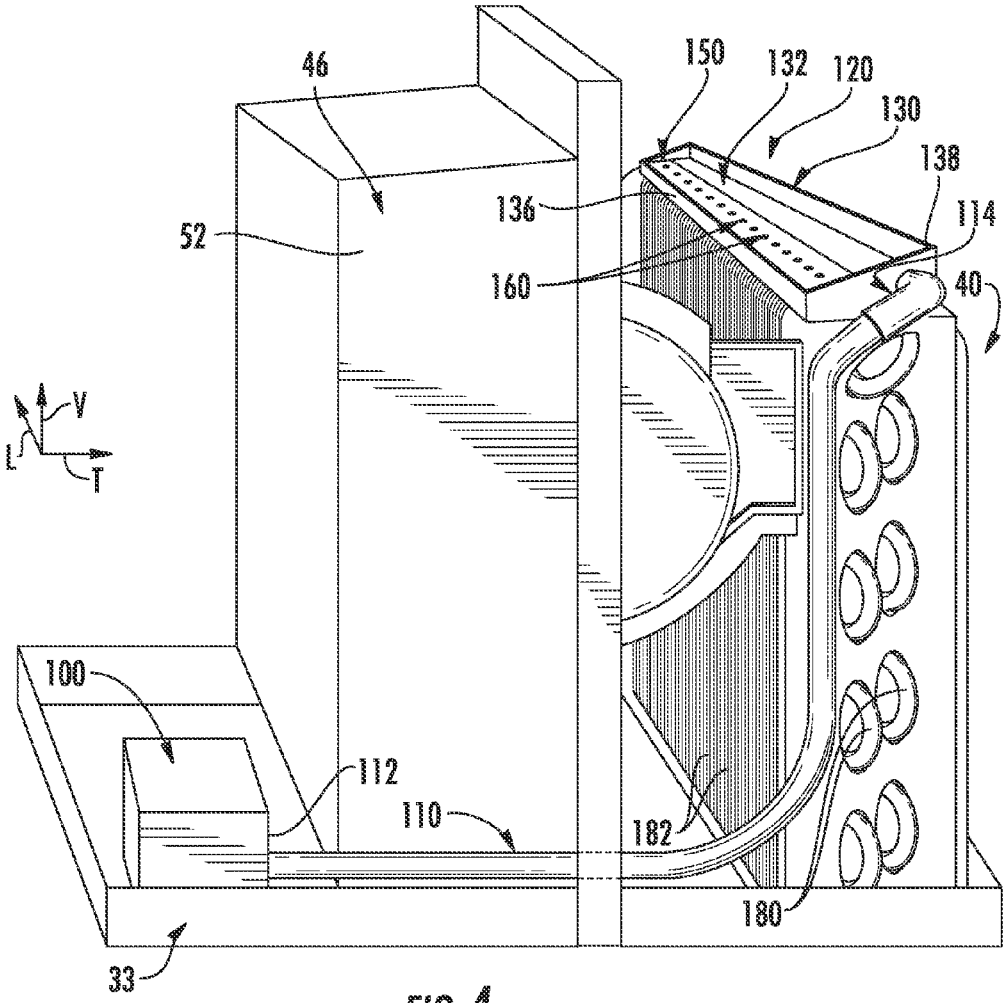
FIG. 4 is side perspective view of components of an air conditioner unit, including a receptacle coupled to an indoor heat exchanger, in accordance with one embodiment of the present disclosure.
Figure 6:
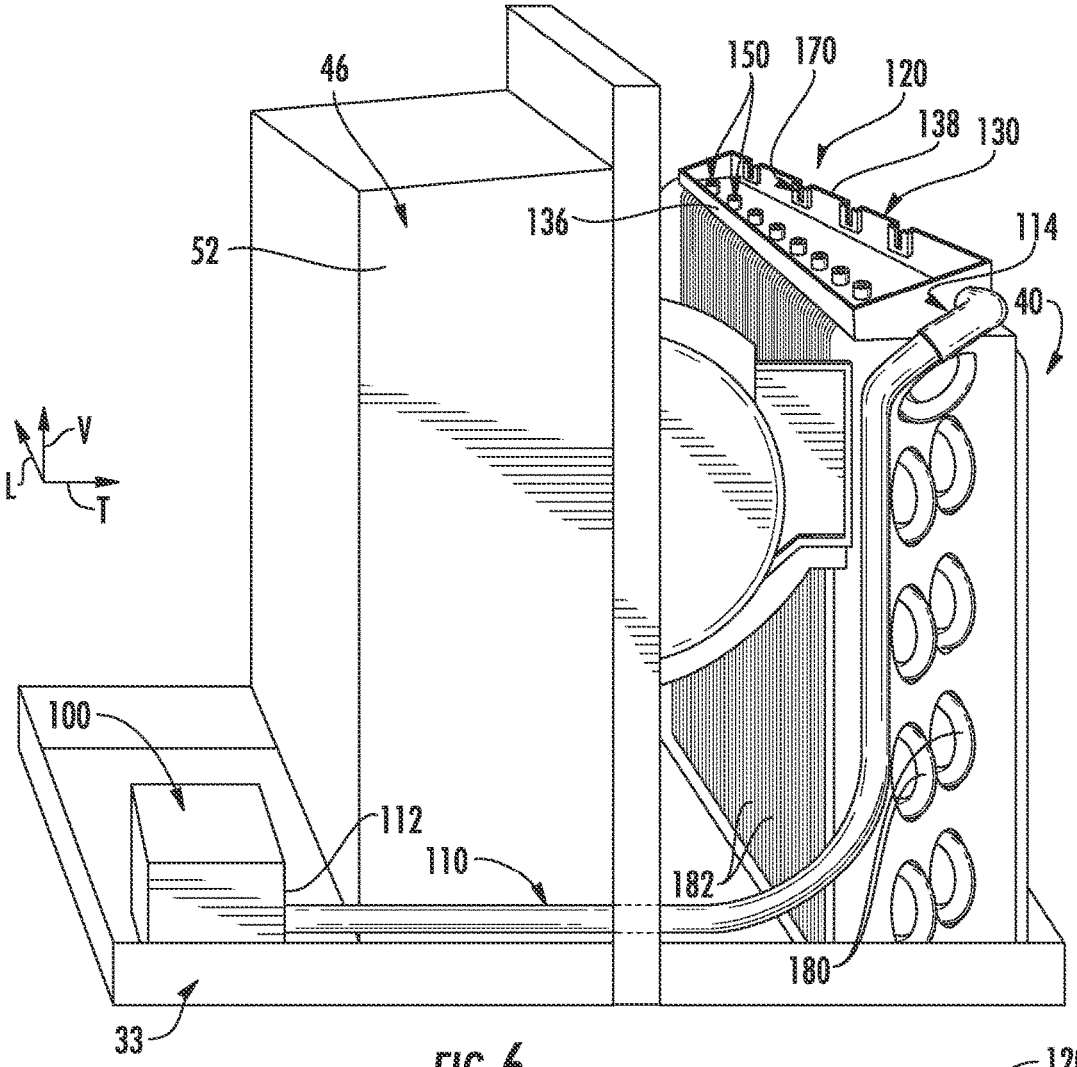
FIG. 6 is side perspective view of components of an air conditioner unit, including a receptacle coupled to an indoor heat exchanger, in accordance with one embodiment of the present disclosure.

Accordingly, referring now to FIGS. 4 and 6, air conditioner unit 10 may further include a pump 100 disposed within the outdoor portion 14, such as in the drip pan 33. The pump 100 may be operational to pump, or actively flow, fluid from the drip pan 33 therethrough and into a conduit 110. The conduit 110, such as a first end 112 thereof, may be in fluid communication with the pump 100. Fluid may thus be received in a passage of the conduit 110 through the first end 112 from the pump 100. The conduit 110 may include and extend between the first end 112 and a second end 114. The first end 112 may disposed in the outdoor portion 14, and the second end 114 may be disposed in the indoor portion 12. For example, the conduit 110 may, as shown, extend through the bulkhead 46, such as through the rear wall 56 or another suitable wall of the bulkhead 46. Fluid flowed through the conduit 110 may thus be flowed from the outdoor portion 14 to the indoor portion 12, wherein the fluid is exhausted from the conduit 110 through the second end 114.

Referring still to FIGS. 4 and 6 as well as to FIGS. 5 and 7-9, a receptacle 120 is disposed in the indoor portion 12 for receipt of fluid from the outdoor portion 14. Accordingly, the receptacle 120 may for example be in fluid communication with the conduit 110, such as with the second end 114 thereof, for receiving fluid from the conduit 110 as the fluid is flowed from the conduit 110.

Receptacle 120 may, for example, include a tray 130 which defines a channel 132 therein. Tray 130 may include a bottom wall 134 and a plurality of sidewalls. The sidewalls may include, for example, a front sidewall 136 and a rear sidewall 138. The rear sidewall 138 may be proximate the bulkhead 46 relative to the front sidewall 136 and along the transverse direction T, and the front sidewall 136 may be distal from the bulkhead 46 relative to the rear sidewall 138 and along the transverse direction T.

Tray 130 may further include a tube 140 (see FIGS. 8 and 9) extending from one of the plurality of sidewalls. A passage 142 may be defined through the tube 140 and sidewall. Conduit 110, such as the second end 114 thereof, may be in fluid communication with the tube 140, such as the passage 142 thereof, such that fluid flowing from the second end 114 flows into and through the passage 142, and from the passage 142 into the channel 132.

Receptacle 120 may further include one or more risers 150. A riser 150 in accordance with the present disclosure may extend from the bottom wall 134 within the channel 132, and may include a raised surface 152 disposed above the bottom wall 134 along the vertical direction V. The riser(s) 150 and channel 132 may define a lower fill area 154, which may include areas of the channel 132 in which riser(s) 150 do not extend from the bottom wall 134, and upper fill area(s) 156, which may include areas of the channel 132 in which riser(s) 150 do extend from the bottom wall 134. Fluid in the lower fill area 154 may be disposed in the channel 132 and between (along the vertical direction V) the bottom wall 134 and the raised surface 152. Fluid in the upper fill area 146 may be above the raised surface 152 (along the vertical direction V).

Further, one or more bores 160 may be defined in the receptacle 120. Each bore 160 may extend through and be defined in the raised surface 152 and the bottom wall 134, such as generally along the vertical direction V. The bores 160 may facilitate the flow of fluid from the upper fill area(s) 156 therethrough and from the receptacle 120. As discussed herein, fluid flowing through the bore(s) 160 may advantageously flow from the bores 160 to the indoor heat exchanger 40.

The use of risers 150 and bores 160 in accordance with the present disclosure advantageously facilitates improved distribution of fluid within the receptacle 120 and flowing from the receptacle 120, such as to the indoor heat exchanger 40. As discussed, fluid from conduit 110 flows into the channel 132. In exemplary embodiments, the fluid received from the conduit 110, such as from the second end 114 thereof and through the passage 142, is flowed from the conduit 110 into the lower fill area 154. As fluid collects in the lower fill area 154, it is advantageously distributed throughout the entire lower fill area 154, such as in the transverse and lateral directions T, L. The generally evenly distributed fluid rises in the vertical direction V within the lower fill area 154 until fluid begins to flow onto the raised surface(s) 152 and into the upper fill area(s) 156. This fluid may thus be flowed from the raised surface 152 into and through the bores 160 defined in the raised surface(s) 152 to be flowed from the receptacle 120 and to the indoor heat exchanger 40. The use of riser(s) 150 and associated raised surface(s) 152 advantageously causes the even fluid distribution (i.e. within the lower fill area 154) before the fluid is flowed into the bores 160, thus ensuring that the fluid flow into and through the bores 160 is relatively more evenly distributed. This, in turn, advantageously provides improved, better distributed (such as generally along the lateral direction L) fluid distribution to the indoor heat exchanger 40.

Figure 5:
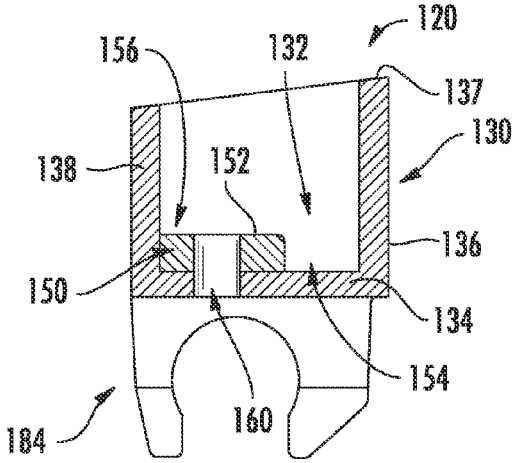
FIG. 5 is a cross-sectional view of a receptacle in accordance with one embodiment of the present disclosure.
Figure 7:
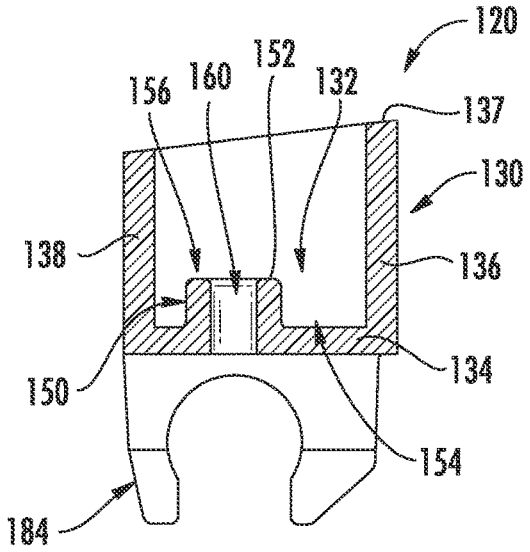
FIG. 7 is a cross-sectional view of a receptacle in accordance with one embodiment of the present disclosure.

In some embodiments, as illustrated in FIGS. 4 and 5, a riser 150 is a shelf which extends through all or at least a portion of the channel 132 along the lateral direction L. A plurality of bores 160 are defined in the raised surface 152 of the shelf and the bottom wall 134. In some embodiments, only a single shelf is utilized (as shown), while in other embodiments, multiple shelfs are utilized. In other embodiments, as illustrated in FIGS. 6 and 7, a riser 150 is a boss which extends through only a portion of the channel 132 along the lateral direction L. A single bore 160 may be defined in the raised surface 152 of the boss. As shown, in these embodiments, a plurality of bosses may be provided, and may be spaced apart from each other (such as in the lateral direction L). The bore 160 of each boss may further extend through the bottom wall 134. Notably, the use of bosses may in some embodiments be particularly advantageous due to the use of relatively minimal material (and associated time and expense) to form the bosses.

Figure 8:
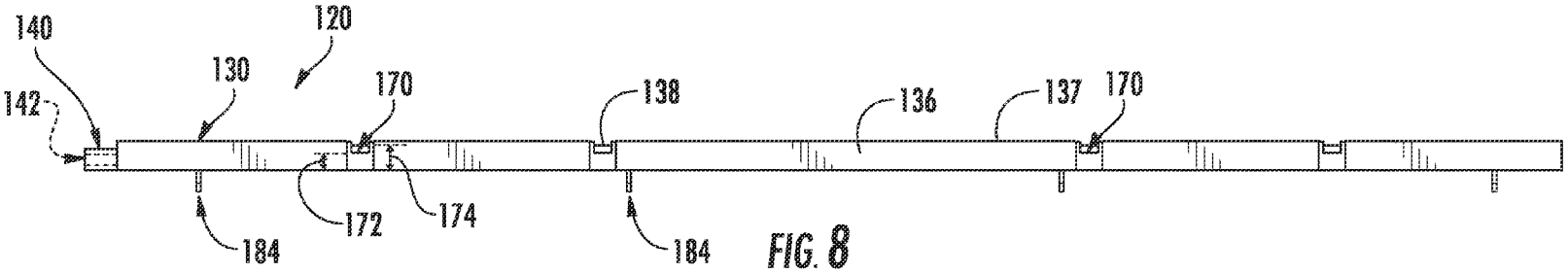
FIG. 8 is a front view of a receptacle in accordance with one embodiment of the present disclosure.

Referring now to FIGS. 6 and 8, in some embodiments, one or more cutouts 170 may be defined in the front sidewall 136. The cutouts 170 may advantageously provide spillover relief and flow direction in the case of excess fluid within the channel 132. In exemplary embodiments, each cutout 170 may extend (such as generally along the vertical axis V) from a top edge 137 of the front sidewall 136. In these embodiments, a height 172 (along the vertical axis V) of the front sidewall 136 at a location of the cutout 170 (and as measured from the bottom wall 134) may be less than a minimum height 174 of the rear sidewall 138 (as measured from the bottom wall 134). In alternative embodiments, each cutout 170 may be a discrete hole defined in the front sidewall 136 (rather than extending from the top edge 137). In these embodiments, a height 172 (along the vertical axis V) of the front sidewall 136 to the bottom of the cutout 170 at a location of the cutout 170 (and as measured from the bottom wall 134) may be less than a minimum height 174 of the rear sidewall 138 (as measured from the bottom wall 134). The height 172, 174 difference may advantageously cause fluid to flow through the cutout(s) 170 before flowing over the rear sidewall 138, thus directing excess fluid in an advantageously direction. Such fluid spillover may thus, for example, spill onto the indoor heat exchanger 40 rather than onto the bulkhead 46 or a component of the indoor portion 12 other than the indoor heat exchanger 40.

Figure 9:
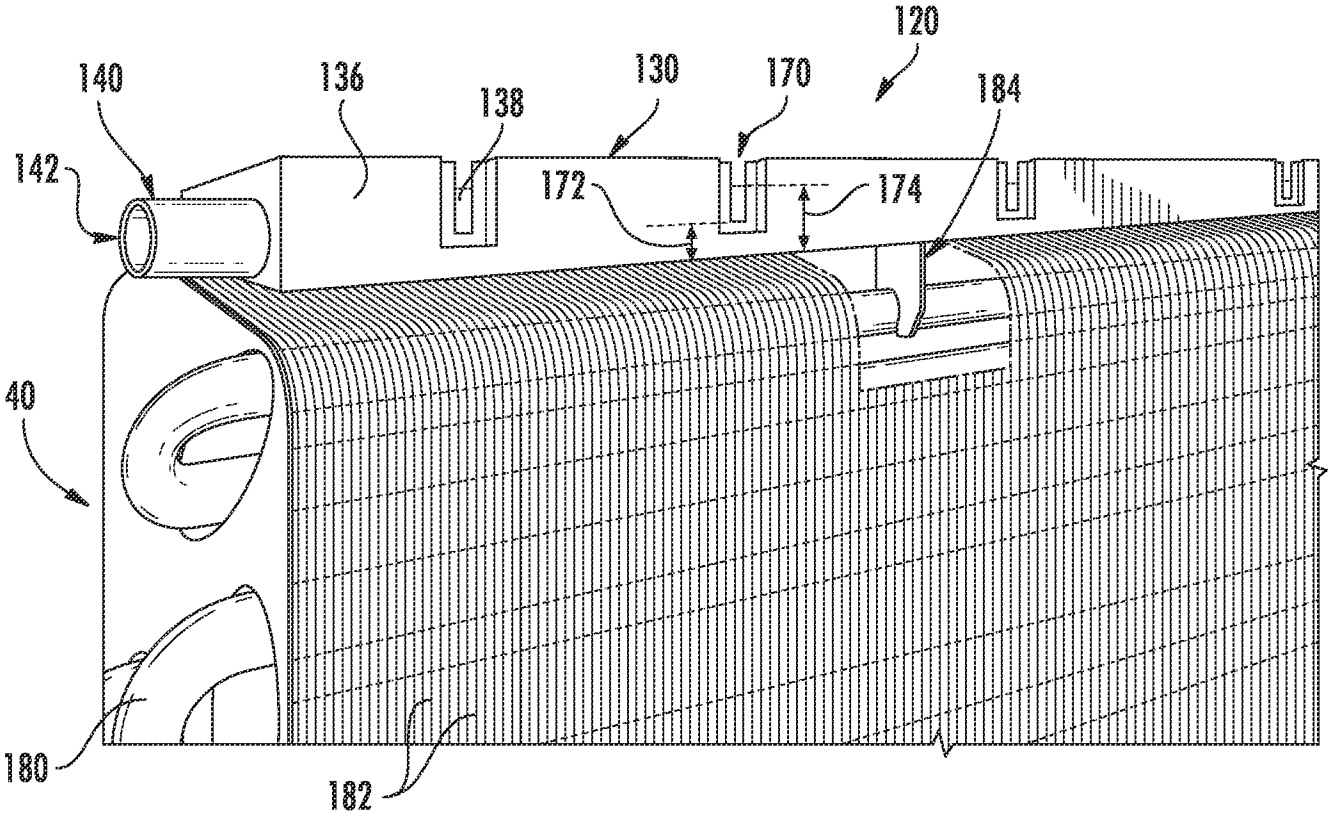
FIG. 9 is a perspective view of a receptacle coupled to an indoor heat exchanger in accordance with one embodiment of the present disclosure.

Referring now to FIG. 9, a receptacle 120 in accordance with the present disclosure may be coupled, such as removably coupled, to the indoor heat exchanger 40. For example, in some embodiments as discussed, the indoor heat exchanger 40 may be an evaporator. The evaporator may include an evaporator tube 180 and a plurality of fins 182 extending from the evaporator tube 180. The receptacle 120 may be coupled to the evaporator tube 180. For example, as shown, the receptacle 120 may further include one or more clips 184, which may extend from tray 130 (such as the bottom wall 134). Each clip 184 may, as shown, be sized and shaped to be connectable (such as removably connectable) to the tube 180 to couple the receptacle 120 to the evaporator.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit, comprising:

an outdoor heat exchanger disposed in an outdoor portion;

an indoor heat exchanger disposed in an indoor portion;

a bulkhead disposed between the outdoor heat exchanger and the indoor heat exchanger along a transverse direction, the bulkhead defining the indoor portion and the outdoor portion, the bulkhead comprising a first sidewall, a second sidewall spaced apart from the first sidewall along a lateral direction, and a rear wall extending laterally between the first sidewall and the second sidewall, the rear wall comprising an indoor facing surface and an opposing outdoor facing surface;

a pump disposed in the outdoor portion;

a conduit in fluid communication with the pump and extending between a first end disposed in the outdoor portion and a second end disposed in the indoor portion; and a receptacle disposed in the indoor portion, the receptacle in fluid communication with the conduit for receiving fluid from the conduit, the receptacle comprising:

a tray defining a channel, the tray comprising a bottom wall and a plurality of sidewalls extending from the bottom wall, the plurality of sidewalls comprising a rear wall proximate the bulkhead and a front sidewall distal from the bulkhead relative to the rear sidewall;

a riser extending from a bottom wall of the tray and comprising a raised surface disposed above the bottom wall along a vertical direction, wherein the channel and the riser define a lower fill area and an upper fill area; and a bore extending through and defined in the raised surface and the bottom wall, wherein the front sidewall extends above the indoor heat exchanger and defines a cutout extending through the front sidewall, wherein the cutout is directed toward the indoor heat exchanger to guide an overflow fluid thereto, and wherein a height of the front sidewall at a location of the cutout is less than a minimum height of the rear sidewall and greater than a maximum height of the riser.

2. The air conditioner unit of claim 1, wherein the cutout extends from a top edge of the front sidewall.

3. The air conditioner unit of claim 1, wherein the riser is a boss, and wherein only a single bore extends through and is defined in the raised surface.

4. The air conditioner unit of claim 1, wherein the riser is a shelf, and wherein a plurality of bores extend through and are defined in the raised surface and the bottom wall.

5. The air conditioner unit of claim 1, wherein the bore is a plurality of bores.

6. The air conditioner unit of claim 1, wherein fluid received from the conduit flows from the conduit into the lower fill area.

7. The air conditioner unit of claim 1, wherein the receptacle is coupled to the indoor heat exchanger.

8. The air conditioner unit of claim 1, wherein the indoor heat exchanger is an evaporator.

9. The air conditioner unit of claim 8, wherein the evaporator comprises an evaporator tube and a plurality of fins extending from the evaporator tube, and wherein the receptacle further comprises a clip extending from the bottom wall, the clip connectable to the tube to couple the receptacle to the evaporator.

10. An air conditioner unit, comprising:

a condenser disposed in an outdoor portion;

an evaporator disposed in an indoor portion;

a bulkhead disposed between the condenser and the evaporator along a transverse direction, the bulkhead defining the indoor portion and the outdoor portion, the bulkhead comprising a first sidewall, a second sidewall spaced apart from the first sidewall along a lateral direction, and a rear wall extending laterally between the first sidewall and the second sidewall, the rear wall comprising an indoor facing surface and an opposing outdoor facing surface;

a pump disposed in the outdoor portion;

a conduit in fluid communication with the pump and extending between a first end disposed in the outdoor portion and a second end disposed in the indoor portion; and a receptacle disposed in the indoor portion and coupled to the evaporator, the receptacle in fluid communication with the conduit for receiving fluid from the conduit, the receptacle comprising:

a tray defining a channel, the tray comprising a bottom wall and a plurality of sidewalls extending from the bottom wall, the plurality of sidewalls comprising a rear wall proximate the bulkhead and a front sidewall distal from the bulkhead relative to the rear sidewall;

a riser extending from a bottom wall of the tray and comprising a raised surface disposed above the bottom wall along a vertical direction, wherein the channel and the riser define a lower fill area and an upper fill area; and a bore extending through and defined in the raised surface and the bottom wall, wherein the front sidewall extends above the indoor heat exchanger and defines a cutout extending through the front sidewall, wherein the cutout is directed toward the evaporator to guide an overflow fluid thereto, and wherein a height of the front sidewall at a location of the cutout is less than a minimum height of the rear sidewall and greater than a maximum height of the riser.

11. The air conditioner unit of claim 10, wherein the cutout extends from a top edge of the front sidewall.

12. The air conditioner unit of claim 10, wherein the riser is a boss, and wherein only a single bore extends through and is defined in the raised surface.

13. The air conditioner unit of claim 10, wherein the riser is a shelf, and wherein a plurality of bores extend through and are defined in the raised surface and the bottom wall.

14. The air conditioner unit of claim 10, wherein the bore is a plurality of bores.

15. The air conditioner unit of claim 10, wherein fluid received from the conduit flows from the conduit into the lower fill area.

16. The air conditioner unit of claim 10, wherein the evaporator comprises an evaporator tube and a plurality of fins extending from the evaporator tube, and wherein the receptacle further comprises a clip extending from the bottom wall, the clip connectable to the tube to couple the receptacle to the evaporator.

* * * * *